US006422213B2

(12) United States Patent
Rumpf et al.

(10) Patent No.: US 6,422,213 B2
(45) Date of Patent: Jul. 23, 2002

(54) DELIVERY DEVICE FOR DELIVERING FUEL

(75) Inventors: Bernd Rumpf, Nidderau; Christian Kochsmeier, Dortmund; Dieter Keller, Aschaffenburg; Peter-Andreas Löw, Rossdorf, all of (DE)

(73) Assignee: Mannesmann Vdo AG (DE)

( * ) Notice: Subject to any disclaimer, the term of this patent is extended or adjusted under 35 U.S.C. 154(b) by 0 days.

(21) Appl. No.: 09/805,788

(22) Filed: Mar. 13, 2001

(30) Foreign Application Priority Data

Mar. 21, 2000 (DE) ..... 100 13 905

(51) Int. Cl.[7] ..... F02M 37/04
(52) U.S. Cl. ..... 123/510; 123/198 D; 137/557
(58) Field of Search ..... 123/509, 510, 123/198 D; 137/557, 508

(56) References Cited

U.S. PATENT DOCUMENTS

| | | | | |
|---|---|---|---|---|
| 3,672,510 A | | 6/1972 | Saito et al. | 210/438 |
| 4,366,837 A | * | 1/1983 | Roettgen | 137/557 |
| 4,423,751 A | * | 1/1984 | Roettgen | 137/557 |
| 4,485,788 A | * | 12/1984 | Hofbauer et al. | 123/452 |
| 5,881,699 A | * | 3/1999 | Brown et al. | 123/514 |
| 5,904,844 A | * | 5/1999 | Stone | 210/232 |

FOREIGN PATENT DOCUMENTS

| | | | |
|---|---|---|---|
| DE | 40 42 238 C2 | 12/1990 | B01D/27/14 |
| DE | 37 39 614 C2 | 9/1991 | B01D/35/14 |
| DE | 36 31 579 C2 | 2/1992 | F02M/37/22 |
| DE | 197 16 979 A1 | 10/1998 | F02M/37/22 |
| DE | 198 28 931 A1 | 12/1999 | F02M/37/22 |
| GB | 892692 | 11/1960 | |
| WO | WO 99/37908 | 7/1999 | F02M/37/22 |
| WO | WO 99/39801 | 8/1999 | B01D/27/07 |

* cited by examiner

*Primary Examiner*—Thomas N. Moulis
(74) *Attorney, Agent, or Firm*—Richard A. Speer; Mayer Brown Rowe & Maw

(57) ABSTRACT

A delivery device (2) for delivering fuel, having a delivery pump (3) and a fuel filter (7), has a bypass line (9) which is conducted past the fuel filter (7). When new, the delivery pump (3) delivers fuel through the fuel filter (7). After the fuel filter (7) has become clogged with dirt, the fuel is delivered by the bypass line (9) through a second fuel filter (10). By this means, pollution of the environment with fuel is kept particularly low.

10 Claims, 2 Drawing Sheets

DELIVERY DEVICE FOR DELIVERING FUEL

BACKGROUND OF THE INVENTION

The invention relates to a delivery device for delivering fuel from a fuel tank to an internal combustion engine of a motor vehicle, having a delivery pump and having a flow line which is connected to the delivery pump and having a fuel filter which is arranged in the flow line.

Delivery devices of this type are frequently used in motor vehicles today and are known in practice. The fuel filter here is arranged within the fuel tank in order to reduce any escape of fuel into the environment. Therefore, when the fuel filter is replaced, a service opening of the fuel tank has to be opened. However, a large amount of fuel escapes into the surroundings through the service opening and the seal to the fuel tank.

The invention is based on the problem of designing a delivery device of the type mentioned at the beginning in such a manner that delivery of fuel after the fuel filter has been clogged with dirt is reliably ensured, and that it largely prevents any escape of fuel into the surroundings.

BRIEF SUMMARY OF THE INVENTION

According to the invention, this problem is solved in that the flow line has a bypass line which is conducted past the fuel filter, and in that means are provided for closing the bypass line in the original state and opening up the bypass line after a designated period of use or stage of wear of the fuel filter.

This design allows the fuel filter which has become clogged with dirt simply to remain within the fuel tank. The fuel is then conducted past the fuel filter. Reliable delivery of fuel is therefore ensured. A service opening of the fuel tank is therefore not required. This largely prevents any escape of fuel into the surroundings.

According to another advantageous development of the invention, the fuel which is conducted past the fuel filter can be filtered in a simple manner if a second fuel filter is arranged in the bypass line.

A contribution is made to further reducing the escape of fuel if the means for closing and opening up the bypass line are intended for arrangement within the fuel tank.

According to another advantageous development of the invention, the number of sealing points on the outside of the fuel tank can be kept particularly small if the bypass line and that region of the flow line which leads through the fuel filter are brought together within the fuel tank.

When a fuel filter has become clogged with dirt, a further fuel filter can be arranged on the outside of the fuel tank if the bypass line and that region of the flow line which leads through the fuel filter each have a connection on the outside of the fuel tank, and if the bypass line has a blind plug. This design keeps any escape of fuel into the environment particularly small over the entire operating period of the fuel filter which is arranged within the fuel tank. In order to keep the pollution of the environment with fuel particularly low, it is, of course, also possible for a plurality of fuel filters to be arranged in the fuel tank. The bypass line which is provided with the blind plug is used exclusively to avoid replacing the fuel tank when all of the fuel filters arranged in the fuel tank have become clogged.

According to another advantageous development of the invention, the means for closing and opening up the bypass line prove to be structurally particularly simple if they have a switch-over valve arranged in the flow line.

For example, the switch-over valve may be actuated manually if the delivery of fuel fails. According to another advantageous development of the invention, a spontaneous interruption to the delivery of fuel can be avoided in a simple manner by means for actuating the switch-over valve after a designated time interval or a designated kilometer reading of the motor vehicle.

The control of the means for closing and opening up the bypass line requires a particularly low constructional outlay if the means for closing and opening up the bypass line can be activated by the pressure upstream of the fuel filter.

According to another advantageous development of the invention, the switch-over valve proves to be structurally particularly simple if it has a closing body which is designed such that it can be displaced longitudinally.

The control of the switch-over valve may, for example, take place manually or under electrical control. However, according to another advantageous development of the invention, the activation of the switch-over valve requires a particularly low outlay if the movement of the closing body can be controlled as a function of the pressure of the delivery pump.

According to another advantageous development of the invention, the switch-over valve can be controlled electrically or manually with a particularly low constructional outlay if the switch-over valve has a rotatably closing body.

DESCRIPTION OF THE DRAWINGS

The invention permits numerous embodiments. To further clarify its basic principle a number of these are illustrated in the drawing and are described below. In the drawing

DETAILED DESCRIPTION OF THE INVENTION

Figure 1:
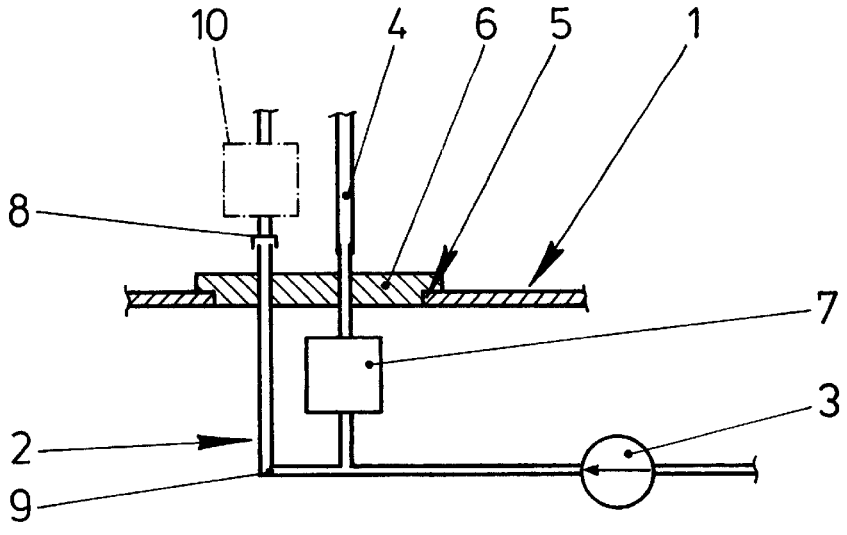
FIG. 1 shows a schematic illustration of a delivery device according to the invention having a single fuel filter.

FIG. 1 shows an upper subregion of a fuel tank 1 having a delivery device 2. The delivery device 2 has a delivery pump 3 for delivering fuel into a flow line 4 leading to an internal combustion engine (not illustrated). The flow line 4 penetrates a flange 6 which is inserted into an installation opening 5. A fuel filter 7 is arranged within the flow line 4. The fuel filter 7 is arranged parallel to a bypass line 9 which is conducted as far as a blind plug 8 located on the outside of the flange 6.

After the fuel filter 7 has become clogged with dirt, the blind plug 8 can be opened and that region of the flow line 4 which is located outside the fuel tank 1 can be connected to the bypass line 9 which is conducted around and past the fuel filter 7. In addition, a fuel filter 10 (which is illustrated by dashed-dotted lines in the drawing) can be fitted on the outside of the flange 6. That region of the flow line 4 which is conducted through the fuel filter 7 arranged within the fuel tank 1 must then, of course, be closed. This enables the fuel to circumvent the fuel filter 7 which has become clogged by the dirt. It is not necessary for this to separate the flange 6 from the fuel tank 1. The flange 6may therefore, for example, be welded or bonded in a gastight manner to the fuel tank 1.

Figure 2:
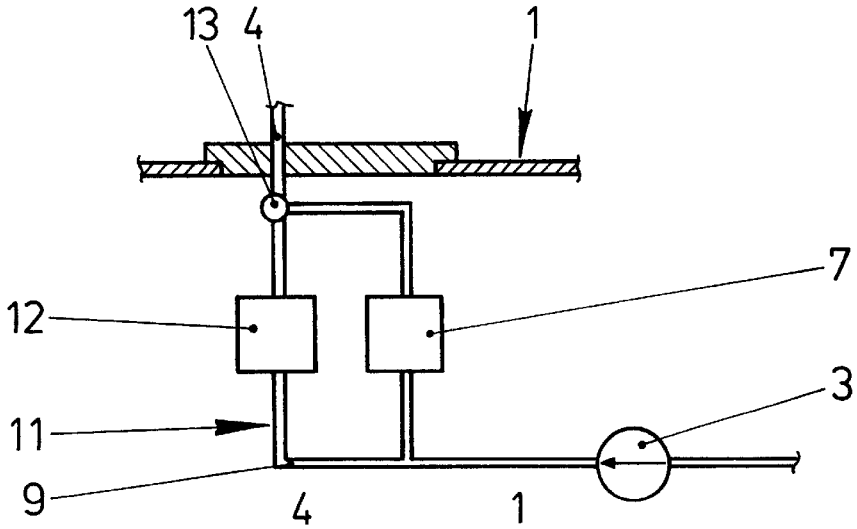
FIG. 2 shows a further embodiment of the delivery device according to the invention having fuel filters which can be switched over alternately.

FIG. 2 shows a delivery device 11 in which a second fuel filter 12 is arranged in the bypass line 9 conducted around the first fuel filter 7. Arranged downstream of the fuel filters 7, 12, as seen in the direction of flow, is a switch-over valve 13 which connects either the one or the other fuel filter 7, 12 to that region of the flow line 4 which is located outside the fuel tank. By this means, when the first fuel filter 7 has become clogged, the switch-over valve 13 can be activated, with the result that fuel flows through the second fuel filter 12.

Figure 3:
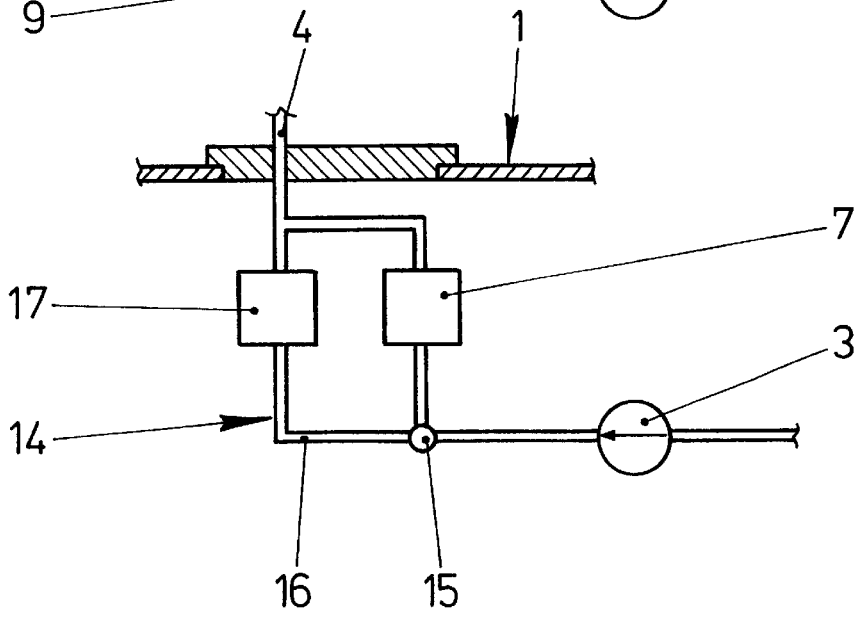
FIG. 3 shows a further embodiment of the delivery device according to the invention having individually activatable fuel filters.

FIG. 3 shows a delivery device 14 in which a switch-over valve 15 is arranged upstream of the fuel filter 7, as seen in the direction of flow. Activation of the switch-over valve enables fuel to either be conducted via the fuel filter 7 or through a second fuel filter 17 via the bypass line 16. As an alternative to this, the second fuel filter 17 can initially be omitted and fitted in that region of the flow line 4 which is located outside the fuel tank 1 only after the switch-over valve 15 has been switched over. Of course, the delivery device 14 can also provide multiple switch-over valves (not illustrated) and two or more bypass lines with or without fuel filters arranged in them.

Figure 4:
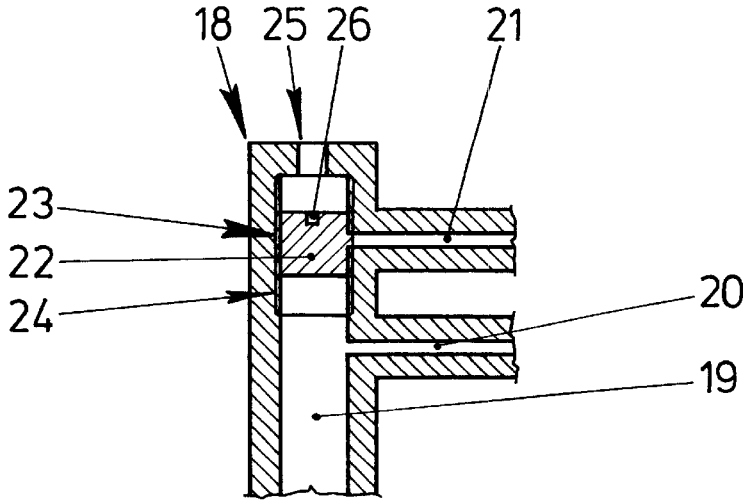
FIG. 4 shows a sectional illustration through a switch-over valve of the delivery device from FIGS. 2 or 3.

FIG. 4 shows a switch-over valve 18 as can be used in the delivery devices 11, 14 according to FIGS. 2 and 3. The switch-over valve 18 has a connection 19 which is connected to the delivery pump 3 illustrated in FIGS. 2 and 3, a connection 20 leading to the first fuel filter 7 and a connection 21 for the bypass line 9, 16. A closing body 22 is arranged in a longitudinally moveable manner in the connection 19 leading to the delivery pump 3, said closing body enabling the connection 21 of the bypass line 9, 16 to be either closed or opened up. For this purpose, the closing body 22 has an external thread 23 and is screwed into an internal thread 24 of the connection 19 of the delivery pump 3. A slot 26 of the closing body 22 in which to fit a rotating tool (not illustrated) is accessible through an opening 25.

Figure 5:
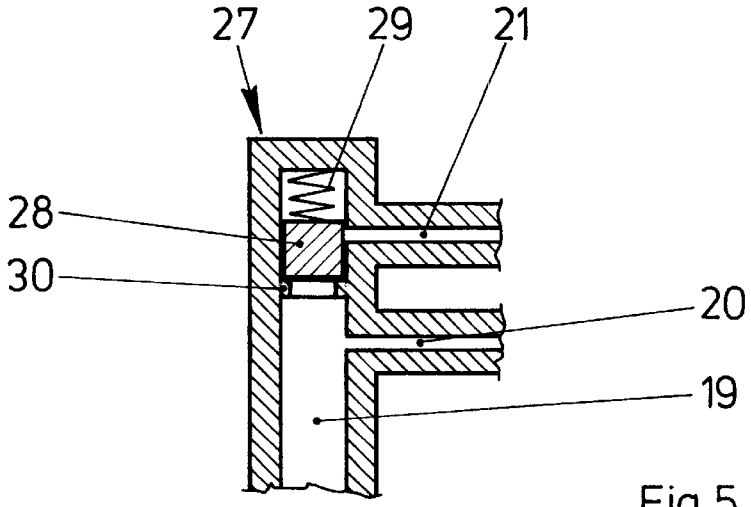
FIG. 5 shows a pressure-actuated switch-over valve of the delivery device from FIG. 3.

FIG. 5 shows a switch-over valve 27 as can be used in the delivery device 14 from FIG. 3. As in the case of the switch-over valve 18 from FIG. 4, the connection 21 of the bypass line 16 can be opened up or closed by a longitudinally moveable closing body 28. In the given position, the closing body 28 is prestressed into the position closing the connection 21 of the bypass line 16 against a stop 30 by a spring 29. When the first fuel filter 7, which is illustrated in FIG. 3, has become clogged, the pressure in the connection 19 of the delivery pump 3 rises. The closing body 28 is then moved by the pressure of the delivery pump 3 counter to the force of the spring 29 until the connection 21 of the bypass line 16 has been opened up.

Figure 6:
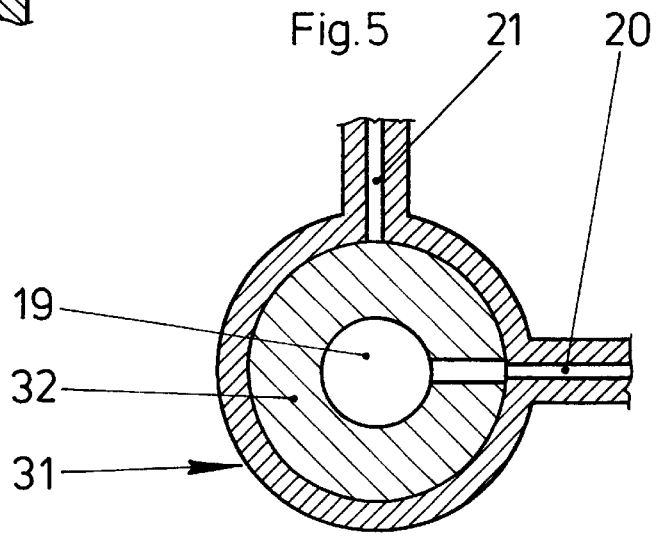
FIG. 6 shows a further illustration of a switch-over valve of the delivery device from FIGS. 2 or 3.

FIG. 6 shows a switch-over valve 31 as can be used in the delivery devices 11, 14 from FIGS. 2 and 3. In this switch-over valve 31 the connection 19 for the delivery pump 3 is arranged centrally. Leading away from this connection 19 is the connection 20 which is connected to the first fuel filter 7 and the connection 21 of the bypass line 9, 16. A rotatable closing body 32 enables the connection 19 of the delivery pump 3 to alternatively be connected to the two other connections 20, 21. The closing body 32 can either be activated electrically or manually.

What is claimed is:

1. A delivery device for delivering fuel from a fuel tank to an internal combustion engine of a motor vehicle, having a delivery pump and having a flow line which is connected to the delivery pump and having a fuel filter which is arranged in the flow line, wherein the flow line (4) has a bypass line (9, 16) and a bypass filter (10, 12, 17) which is conducted past the fuel filter (7), and wherein means are provided for closing the bypass line (9, 16) in the original state and opening up the bypass line (9, 16) after a designated period of use or stage of wear of the fuel filter (7).

2. The delivery device as defined in claim 1, wherein the means for closing and opening up the bypass line (9, 16) are intended for arrangement within the fuel tank (1).

3. The delivery device as defined in claim 3, wherein the bypass line (9, 16) and that region of the flow line (4) which leads through the fuel filter (7) are brought together within the fuel tank (1).

4. The delivery device as defined in claim 1, wherein the bypass line (9) and that region of the flow line (4) which leads through the fuel filter (7) each have a connection on the outside of the fuel tank (1), and wherein the bypass line (9) has a blind plug (8).

5. The delivery device as claimed in claim 5, wherein the means for closing and opening up the bypass line (9, 16) have a switch-over valve (13, 15, 18, 27, 31) arranged in the flow line (4).

6. The delivery device as claimed in claim 6 comprises means for actuating the switch-over valve (13, 15, 18, 27, 31) after a designated time interval or a designated kilometer reading of the motor vehicle.

7. The delivery device as defined in claim 1, wherein the means for closing and opening up the bypass line (16) can be activated by the pressure upstream of the fuel filter (7).

8. The delivery device as defined in claim 5, wherein the switch-over valve (13, 15, 18, 27) has a closing body (22, 28) which is designed such that it can be displaced longitudinally.

9. The delivery device as defined in claim 8, wherein the movement of the closing body (22, 28) can be controlled as a function of the pressure of the delivery pump (3).

10. The delivery device as defined in claim 6 wherein the switch-over valve (31) has a rotatable closing body (32).

* * * * *